US011633869B1

(12) United States Patent
Tammera

(10) Patent No.: US 11,633,869 B1
(45) Date of Patent: Apr. 25, 2023

(54) BIODEGRADABLE DISPOSABLE SAFELY SHAVING RAZOR

(71) Applicant: Robert Frank Tammera, Warrenton, VA (US)

(72) Inventor: Robert Frank Tammera, Warrenton, VA (US)

( * ) Notice: Subject to any disclaimer, the term of this patent is extended or adjusted under 35 U.S.C. 154(b) by 36 days.

(21) Appl. No.: 17/643,613

(22) Filed: Dec. 10, 2021

(51) Int. Cl.
*B26B 21/40* (2006.01)
*B26B 21/52* (2006.01)
*B26B 21/44* (2006.01)

(52) U.S. Cl.
CPC ..... *B26B 21/4012* (2013.01); *B26B 21/4037* (2013.01); *B26B 21/446* (2013.01); *B26B 21/52* (2013.01)

(58) Field of Classification Search
CPC ..... B26B 21/00; B26B 21/14; B26B 21/40; B26B 21/4012; B26B 21/4037; B26B 21/446; B26B 21/52; B26B 21/522
USPC ..... 30/41, 41.5, 47–51, 526, 537, 539; D28/46–48
See application file for complete search history.

(56) References Cited

U.S. PATENT DOCUMENTS 3,399,455 A * 9/1968 Steere, Jr. ..... B26B 29/00 D28/47
4,177,556 A * 12/1979 Galli, Jr. ..... B26B 21/446 30/41
4,205,441 A * 6/1980 Turner ..... B26B 21/446 30/41.5
4,228,586 A * 10/1980 Thierry ..... B26B 21/446 30/41
4,392,303 A * 7/1983 Ciaffone ..... B26B 21/521 30/526
D274,010 S * 5/1984 Iten ..... D28/47
4,480,387 A * 11/1984 d'Alayer de Costemore d'Arc ... A45D 27/46 30/41
4,640,012 A * 2/1987 Thomas ..... B26B 21/40 30/41
4,733,468 A * 3/1988 Zadro ..... B26B 21/40 30/41.5
4,809,432 A * 3/1989 Schauble ..... B26B 21/446 30/41
D304,773 S * 11/1989 Beuchat ..... D28/46
4,941,492 A * 7/1990 Morgan ..... B26B 21/40 30/41
5,075,969 A * 12/1991 Jursich ..... B26B 21/52 30/41
5,241,751 A * 9/1993 Goh ..... B26B 21/52 30/41

(Continued)

*Primary Examiner* — Jason Daniel Prone

(57) ABSTRACT

A biodegradable unisex disposable safety razor includes an ergonomic handle and a fixed head arranged on one end of the handle. The head includes a skin contacting surface, an internal process cavity with a single blade having a single cutting edge. The blade communicates with four independent passages located on the head. The device, which functions with no moving parts and/or electronics has an integrated and enhanced; skin lubrication system, an acoustic alert method for achieving an optimal shave, a method to alternate the shaving blade material temperature, dependent care assist functionality, a fully internal surface wetting antibacterial protection method, an external user safety protection guard, a post shave debris clean-out in conjunction to a fully internal material surface dry-out sanitization system aimed at improving the devices overall hygiene.

14 Claims, 8 Drawing Sheets

(56) References Cited

U.S. PATENT DOCUMENTS 5,265,337 A * 11/1993 Lowder ..... B26B 21/40 30/41
5,335,417 A * 8/1994 Genero ..... B26B 21/522 30/41.5
5,386,750 A * 2/1995 Morrison ..... B26B 21/42 30/31
5,402,697 A * 4/1995 Brooks ..... B26B 19/42 30/41
5,537,749 A * 7/1996 Cacioppo ..... B26B 21/40 30/41.5
5,600,887 A * 2/1997 Olson ..... B26B 21/4037 30/41.5
5,673,485 A * 10/1997 Hill ..... B26B 21/446 30/41.5
5,771,592 A * 6/1998 Nizker ..... B26B 21/40 30/540
6,006,760 A * 12/1999 Benzinger ..... B26B 21/40 30/41
6,009,622 A * 1/2000 Liedblad ..... B26B 21/40 30/41
6,112,412 A * 9/2000 Richard ..... B26B 21/443 30/41.5
D443,111 S * 5/2001 Nakasuka ..... D28/47
6,257,247 B1 * 7/2001 Benzinger ..... B26B 21/40 30/41
6,305,082 B1 * 10/2001 Troncoso ..... B26B 21/40 30/41
6,499,218 B2 * 12/2002 Rocha ..... B26B 21/4012 30/41.5
6,539,633 B1 * 4/2003 Rebaudieres ..... B26B 21/4037 30/539
7,007,390 B2 * 3/2006 Mislove ..... B26B 21/40 30/41
7,043,842 B1 * 5/2006 Taylor ..... B26B 21/44 30/41.5
D587,846 S * 3/2009 Wonderley ..... D28/48
D619,300 S * 7/2010 Wonderley ..... D28/47
D619,763 S * 7/2010 Coresh ..... D28/48
D624,242 S * 9/2010 Bridges ..... D28/47
7,788,810 B2 * 9/2010 Noble ..... B26B 21/446 30/41.5
D635,302 S * 3/2011 Psimadas ..... D28/48
D636,938 S * 4/2011 White, Jr. ..... D28/48
8,273,205 B2 * 9/2012 Murgida ..... B26B 21/522 D28/48
D703,377 S * 4/2014 Christie ..... D28/48
D750,324 S * 2/2016 Bae ..... D28/48
D763,506 S * 8/2016 Barrett ..... D28/46
9,868,220 B2 * 1/2018 Moffat ..... B26B 21/4037
10,335,969 B2 * 7/2019 Moffat ..... B26B 21/4037
10,406,704 B2 * 9/2019 Barrett ..... B26B 21/522 D28/47
D872,364 S * 1/2020 Riley ..... D28/47
D877,981 S * 3/2020 Tammera ..... B26B 21/40 D28/46
10,974,401 B2 * 4/2021 Moffat ..... B26B 21/40
2002/0144404 A1 * 10/2002 Gilder ..... B26B 21/227 30/41
2005/0066527 A1 * 3/2005 Wakayama ..... B26B 21/4037 30/41
2006/0272154 A1 * 12/2006 Brevard ..... B26B 21/446 30/41
2012/0311863 A1 * 12/2012 Bennik ..... B26B 21/522 30/41
2013/0160297 A1 * 6/2013 Coleman ..... B26B 21/446 30/41
2013/0276311 A1 * 10/2013 Clemons ..... B26B 21/4037 30/539
2015/0266189 A1 * 9/2015 Alsalameh ..... B26B 21/446 30/41

* cited by examiner

BIODEGRADABLE DISPOSABLE SAFELY SHAVING RAZOR

FIELD OF THE INVENTION

This invention is an improved and complete biodegradable disposable safety shaving razor having at least one blade and cutting edge, which employs fundamental design improvements. Features of the razor include enhancing the shavers topical skin comfort via the release of stored tempered tap water, stored creams or gels, a method of altering the razor blades material temperature, incorporating a debris clean-out system, an acoustic alert method to determine the best shaving angle, an ergonomically styled handle that aids shaving dexterity having a non-slip safety design and a series of ventilation passages that will hygienically air-dry all internal surfaces. The inclusion of a blade safety guard that additionally promotes improved razor hygiene. One or more features of this invention can be applied for shaving devices of all types including those used by both males and females alike.

BACKGROUND OF THE INVENTION

A common shaving technique to remove unwanted facial and body growth hair is to first precondition wet skin with commercially available; shaving foam, gel, soap or creams. The shaving razor apparatus is then gently hand guided by contouring the bodies' skin, trimming the growth hair strands as it plows through the fore mentioned skin conditioning agent. After several guided strokes the apparatus is ordinarily cleaned with running tap water to remove the accumulated trimmed hair whiskers, skin conditioning agent and loose skin flakes. The shaving procedure then resumes with limitless paths, directions and razor orientations. The preconditioning agent in part softens the uncut hair strand as it also conditions the skin's topical tissue to lessen skin irritation commonly known as razor burn.

When employing wet razor shaving, there is an advantage to hearing the faint sounds made by the razor blade as it trims the hair follicles. A user will often adjust the shaving angle by listening to the guiding sounds.

Many shaving razor and unique device innovations have been made since the inception of the safety razor thereof. The most recent marketing trends include increasing the number of shaving blades, provide a mechanical pivotal joint between the shaving head and handle, offer interchangeable blade assemblies, and include multiple skin lubrication devices per apparatus. Moreover, it is known that when shaving razor devices are not properly cleaned following each usage harmful bacteria can grow within the shaver and there can be the cause of skin infections.

Common end user problems can result from multi-blade assemblies which lead to skin irritation. This is because the multi-blade heads are difficult to clean after each shave. In addition, the complex pivotal joint action used on some razors require special cleaning. In addition, interchangeable blade assemblies are in general too costly and the skin lubrication devices do not necessarily work. Shavers in current use also have multiple interconnecting components, which amounts to a large material surface area where harmful bacteria growth can occur. In most cases with such devices, there are hidden surfaces which are not easily accessible for adequate cleaning.

Prior art documents, which disclose shaving devices employing wet shaving razor systems include; U.S. Pat. Nos. 3,274,682, 3,417,468, 4,129,942, 4,392,303, 4,635, 361, 4,941,492, 5,265,337, 5,365,958 A, U.S. Pat. Nos. 5,537,749, 6,185,827 B1, 7,007,389 B1, 8,307,552 B1, 8,327,544 B2 and 6,499,218 B2. The entire disclosure of each of these documents is herein incorporated by reference.

All subject art discloses various methods and unique designs to accomplish razor shaving but do not directly incorporate any of the herein disclosed inventive features along or in combination.

SUMMARY OF THE INVENTION

The invention is aimed at directionally improving the shaving experience by addressing; shaving comfort, shaving performance, daily clean-up maintenance, general safety, overall unit costs and design attention given to promote better hygiene.

The invention advantageously accommodates at least one-single edge fixed cutting razor blade. The final end of life or disposable decision for the inventive shaver can then be defined when the shaving razor's cutting edge becomes ineffective due to expected blade tip dullness or blade material corrosion. The complete shaving razor and included retail packaging can be entirely disposed of via an ergonomic biodegradable recycling center. The contained apparatus conforms to commonly known shaving techniques and will work seamlessly with all commercially available skin preparation agents and a tempered tap water supply.

The invention can be assembled by joining only two-specially formed rigid parts and one-common single edge razor blade. Once assembled, the invention has essentially no moving parts, valves, temporary closures, pressure sealed vessels, electronics or storage containment areas. The invention aims to reduce internal hidden volumetric surface areas, which can promote bacteria growth if not thoroughly cleaned. The multi-sided open frame handle functions without the need to incorporate a bi-material soft topical skin like covering or appearance trim. The invention also need not incorporate a subordinate energy source to assist in its functionality or purpose.

One or more improvements of the invention can be incorporated into a single fixed blade handheld manual shaving razor. The razor can be operated in any conventional orientation, which will function by either right-handed or left-handed individuals. To avoid the need of incorporating a complex pivot mechanism, this device head has a planar surface, which is tangent to a curved architecture such that it conforms to all shaving profiles by adjusting one's wrist angle. To provide a wet lubricating shave this device works in conjunction with the user's water supply via wash basin and or tap water. During the normal shaving routine, the device is momentarily introduced to a stream of tempered water. The water is immediately collected within the head of the razor through a bidirectional passage, which excludes the handle. The stored liquid is immediately transferred to the ones skin, which is aimed at reducing skin irritation. The point of liquid discharge is immediately before the whisker hairs have been trimmed. The tempered water is simultaneously routed through the razor head, which in effect alters the surface material temperature of the metallic shaving blade.

The devices razor head utilizes a hollow process cavity that provides several purposes. The process cavity acts as a collection zone, which temporarily stores and transfers the aforementioned water stream. The razor blades surface area retains the instant temperature of the input water. A second feature of the hollow cavity relates to creating an acoustic amplifier. The hollow process cavity helps to transmit and amplify sounds produced when trimming the hair follicles. The amplified sounds are transmitted through the liquid input passage, which is not blocked by any solid material or one's hand or fingers. The benefit of hearing the trimmed follicles works in parallel to naturally adjusting the shaving angle of the device to achieve a constant or consistent shave. The ideal pivot angle is achieved when the profile of the device comes in direct contact with one's shaving surface.

The immediate area below the shearing edge of the blade is defined as an entry location into the process cavity. When shaving, trimmed hair follicles and spent conditioner cream will enter this zone. During normal shaving, clean tap water will typically clear said process cavity of all collected materials. The internal process cavity is designed such that it will simultaneously clean the shearing edge of the razor blade as well as all the internal process cavity surfaces as it also renews the liquid collection pool in a single operation.

The device can further assist the user's specific needs when injecting commercially available; shaving foam, gel, soap, skin oil or creams into the portal. Said passage is integral to the razor head's internal architecture, which serves as the paramount entry to feed said commercial materials into the process cavity. This is not a mandatory requirement to operate the device but serves a specific purpose and convenience for some user's procedure or to render dependent care assist when someone cannot shave themselves.

The handle is designed such that it has a defined open passageway that is intended to collect accumulated water from the user's wet hand. The upper portion of the handle has an indentation with a series of curved ridges that accommodate the thumb and/or index finger for improved operation dexterity. This design feature eliminates the need to provide additional anti-slip materials commonly associated to most shaving razors. This design is also aimed at controlling material, fabrication costs in conjunction to improved styling, end user safety and ergonomic handling.

Device prototype testing confirmed this innovation has demonstrated the following novel shaving comfort features: a tempered cutting blade, a water induced skin lubrication, a cream induced shave, an audible shaving system, a thoroughly backwashed shearing blade edge and a complete naturally air-dried internal surface. The functional test units have provided a remarkable comfortable shave compared to commercially available wet shaving devices. In conclusion; this device is believed to offer more natural water skin lubrication, efficient whisker/cream debris clean-out and an audible shaving sound enhancement to adjust to one's ideal trimming angle.

Non-Limiting Embodiments

A number of non-limiting inventive features are shown in the drawings. These include a first improvement which is aimed at lubricating one's skin with fresh tap water, which is set to any desired temperature. The handle has significantly more open surface areas than a typical safety shaver. The combined open surface area allows the water to shed from the user's hand more easily and quickly making the handle less slippery and easier to control.

A second improvement is directed at easily clearing the post trimmed hair follicles and shaving lather from the device. The architecture of the internal cavities open volume of the razor head makes it easier to clean or clear out post shaving debris. The advantage to easily clear out the post shave debris will directionally improve the shaving experience. A thoroughly cleaned blade will also reduce the chance of corroding the metallic razor blade. The combination of these features will ultimately improve upon the purposeful usage and lifespan of the razor blades shearing edge.

A third improvement is directed at the side profile of the razor head, which is designed to self-contour to one's skin without moving parts. The curved profile is tangentially joined to a planar surface that aligns with the termination of the razor blades shearing edge. The combined geometric shapes provide an ideal trimming zone that can navigate over countless skin contours. The fixed architecture will address many shaver profiles without the need of complex or expensive pivoting mechanisms. Typical safety razors use a fully planar skin contacting surface which necessitates a pivoting head.

A fourth improvement is directed at reducing the risk of germinating bacteria growth within the razor's internal surfaces. Commonly available liquid disinfectants can be introduced to the device as easily as the aforementioned tap water, which is now aimed at improving the devices overall hygiene. By installing the blade safety cover after usage and introducing a small amount of common medical grade disinfectant type alcohol into the open portal. The safety cover will retain a liquid while the razor heads process cavity will coat the exposed internal surfaces with said alcohol. The dual purpose of this post shaving benefit will sanitize the internal surfaces of the razor head and also promote the extended lifespan of the razor blades shearing edge.

A fifth improvement is related to optimizing one's shaving angle by listening to the auditable sounds produced through the device as it trims hair follicles. The combined razor head process cavity and bidirectional passage jointly function to amplify the sound of shaving. This feature acts to inform the shaver in real time that they have a correct or incorrect shaving angle. A correct shaving angle can be heard or felt whereas an incorrect one can be made conspicuous by its lack of or reduced sound or audible vibration.

A sixth improvement is related to an artery of liquid inlet and outlet passages. The aforementioned bidirectional inlet passage located on top of the razor head communicates with a lower longitudinal passage and two adjacent side passages, which are all part of the razor head's architecture. Liquid can independently bidirectionally enter or discharge through any of the four-passage locations as desired by the user. Said passages also collaborate in conjunction as a ventilation system to self-air-dry all the internal volumetric surfaces, which are aimed at improving the overall device's hygiene.

A seventh improvement is directed at achieving repeatable user interaction without subordinate feature adjustments or additional required mechanical settings.

A eighth improvement is directed at improving the overall safety when handling the device with wet hands by optimizing the handles shape such that it redirects the latent water.

A ninth improvement is directed at limiting one's yearly personal grooming costs by providing a cost-effective device with all around comfort features. Embodiments of the razor can be made of only three rigid components of which one is the metallic razor blade. The given assembly of said razor need not have any moving parts.

A tenth improvement is directed at lessening user hand injuries when attempting to clean and clear away post trimmed hair follicles and shaving debris at the blades shearing edge.

An eleventh improvement is directed at eliminating the need to produce this device solely from non-ecological plastic materials, which helps reduce the growing landfill accumulation problem. This disposable shaving razor can be injection molded from commercially advanced materials other than customary plastic resin-based feedstock, which is not considered to be biodegradable. This device can be injection molded from many available plant-based granular compositions having an ecology friendly resin slurry. Commercially available plant-based feedstocks, which are known to be biodegradable are directionally aimed at decomposing when sent to a recycling facility. The preferred biodegradable material selection will include the device's blade cover and packaging. The spirit of the invention takes full advantage of having a simplified architecture, which blends seamlessly with current advancements in modern injection molded biodegradable type materials.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DESCRIPTION OF NON-LIMITING EMBODIMENTS

Figure 1:
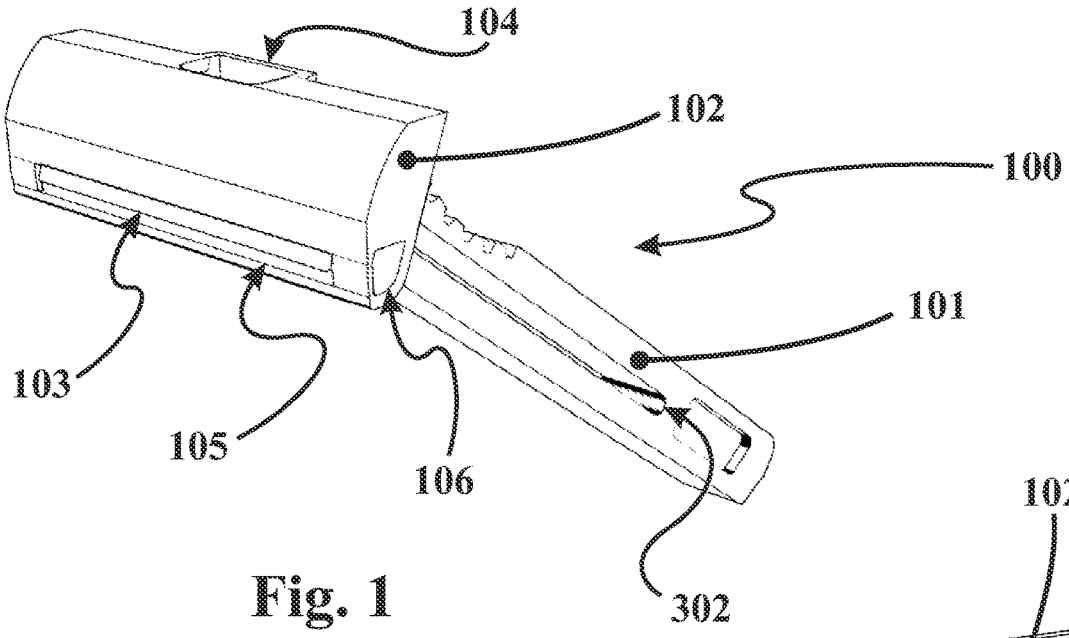
FIG. 1 shows a three-dimensional view describing the assembled razor.

Unless otherwise defined, all design features and descriptive terms used herein have the same meaning as commonly understood by one of ordinary skill in the art to, which this disclosure pertains. Descriptive terms such as; front, top, back, side, bottom, cross-section, perspective, three-dimensional and partial view or section all pertain to the relevant drawing and figure subject views and direct line of sight. The terms are further used to clarify the relationship between the various elements. All referenced or noted dimensions are expressed in English Units.

The referenced embodiments fabrication materials, adhesives, construction assembly procedures, methods and examples thereof are only illustrative and not to be understood as limiting or absolute.

The term as used herein "shave", "shaving", "shaved", "shaver" or "shaving process" refers to the act of a person skilled in the art of removing unwanted hair strand growth with a unique tool of, which this invention represents in its entirety. The examples thereof are only illustrative and not to be understood as limiting or absolute.

The term as used herein "follicle", "follicles", "hair follicle" of "hair follicles" "whisker", "whiskers" refers to the post removal of common hair strand growth.

The term as used herein, "architecture" or "architecture geometry" refers to an embodiment's geometric physical parameters as an example thereof is only illustrative and not to be understood as limiting or absolute.

The term as used herein, "razor" refers to an ordinary hand held shaving device, which is commonly used to remove unwanted short body hair growth for either gender. Said device is understood to function without; electronic circuitry, electric wires, pressure containment vessels, magnetic flux, stored mechanical energy, stored electric energy and or an electric motor with a coupled mechanized drive train.

The term as used herein "razor blade", "blade edge", "cutting blade" or "blade" all refer to a formed metallic strip, which is integrated into the embodiment in plurality. Said element has one leading edge that is precision machined and is intended to slice through a broad number of hair strands at a time. Said blade is permanently fixed in position and is not intended to be reconditioned, removed or replaced once it is no longer usable.

The term as used herein "shear edge" or "blade shear edge" refers to the longest and sharpest edge of the razor blades assumed cutting side.

The term as used herein "dull", "dullness", "dull razor" or "blade tip dullness" refers to the condition where the machined edge of the razor blade has reached it performance limit. At this point the razor blade should not be used for efficient shaving.

The term as used herein "multi-use" refers to an apparatus, which can function in any handheld orientation. Said device can be used by either gender for removing unwanted body growth hair.

The term as used herein "user", "user's" or "one's" refers to a person skilled in the art of shaving for, which this invention would service.

The term as used herein "disposable" or "disposable shaving razor" refers to an apparatus that is intended to have a limited user life span and will be discarded after the razor blade performance level has deteriorated. Said self-contained device is understood to have no available replacement blades in any form or interchangeable components.

The term as used herein "handle" refers to a portion of the apparatus, which controls the movement and pivot ability by the user's hand skills. Said hand is understood to include; fingers, palm and wrist without limiting its dexterity or range of motion. Said apparatus is designed for ambidextrous use.

The term as used herein "liquid weep slot" or "slot" refers to a generally rectangular passage area located either below the razor blades leading or cutting edge or perpendicular to it. Said areas all provide natural liquid drainage paths.

The term as used herein "stream" refers to a fluid being entrained into the apparatus at a specified entrance and will exit through a specified termination location.

The term as used herein "passage", "open passage" or "bi-directional passage" refers to a defined opening such as a portal by which any flowable material can pass through it in either flowable direction. The bi-directional passage provides a specific location for hearing amplified sounds that are generated when shaving.

The term as used herein "tempered" or "tempered water" refers to a desired water temperature that could be less than, equal to, or greater than an ambient temperature setting. The desired temperature is derived by blending both independent cold and hot water streams through a common discharge tap or conduit.

The term as used herein "tap" or "tap water" refers to a mechanical hand actuated water valve commonly integrated to a washroom sink or basin, which supplies a desired water stream. Said stream is ordinarily user adjusted to deliver a desired flow rate, quantity and water temperature ranging from less than, equal to, or greater than ambient water temperature.

The term as used herein "dominate", "dominate direction" or "one dominate direction" refers to a predetermined water stream having a single-entry location, which further develops a flow stream having no directional change. Said stream additionally has a predetermined set minimal travel distance within its given area of travel.

The term as used herein "irritation", "skin irritation" or "razor burn" refers to a self-inflicted trauma to the topical skin tissue commonly caused by either a; mishandled, worn or dull shaving razor.

The term as used herein "skin agent", "skin preparation agent" or "skin conditioning agent" refers to all commercially available topical skin care products that is ordinarily used in the hand held shaving razor process. Commonly available product line recognized by one of ordinary skill to include but not limited to just; shaving foam, gel, soap, oil or cream'.

The term as used herein "plow", "plows" or "plowed" refers to an action by a person skilled in the art who moves said razor through a dense accumulation of skin agent commonly found on the topical skin surface.

The term as used herein "debris" refers to the combined hair follicles, whiskers, skin tissue, skin flakes and shaving lathers that have accumulated in the post shave process.

The term as used herein "leading edge" refers to the outer most extremities of the said frame. This area plows the pre-shaved topical skin tissues and conditioning agent ahead of the razor blade instantly shearing the broad hair strands.

The term as used herein "shaving longevity", "shaving longevity range" refers to a period measuring the total number of expected shaves, which represent the ultimate consumer usage or product lifespan of the disposable razor up and to the point of disposal. For example, after the shaving blade becomes ineffective and the razor unit is discarded.

The term as used herein "plural", "plurality" or "in plurality" refers to a desired quantity of more than-one when referencing a specified item.

The term as used herein "upright" or "natural orientation" refers to one of the handheld razors operating positions. This position is understood to be when the central handle is vertical and the spherical termination is at the lowest elevation and the razor's frame and blades are at their highest elevation.

The term as used herein "vent", "ventilation" or "ventilation system" refers to a portal or series of portals that work in conjunction, which are aimed at air-drying all internal surfaces.

The term as used herein final assembly, "engage", "engaging" or "engagement" refers to the physical method of permanently locking dissimilar items together with tools or force, so they can function in unity.

The term as used herein user, "razor head" refers to the physical location which houses the razor blade, which is not part of the devices handle.

The term as used herein "cavity", "process cavity", "hollow cavity" or "hollow process cavity" refers to a specified area that can be measured in cubic volume and functions as a specific area that performs a change in either fluid or thermal conditions.

The term as used herein "slice", "shear", "sheared", "shearing", "trim", "trimming" or "trimmed" refers to the physical action of cutting the ordinary hair strand.

The term as used herein "care assist" or "dependent care assist" refers to providing care giver assistance to someone who is unable to perform the task to them self.

The term as used herein "microscopic germ" refers to harmful bacteria that grows within the inner surfaces of internal liquid unreachable containment areas.

The term as used herein "hygiene" refers to measures taken to promote general cleanliness through an improved shaving razor, which is aimed at preventing harmful bacteria from collecting in unreachable areas. This safety measure demonstrates a method of which this invention represents in its entirety.

The term as used herein "acoustic", "audible", "sound enhancement" and "amplified" all refers to the generation of sounds derived through the vibration of the shaving device and hair follicle.

The term as used herein "biodegradable" refers to a material capable of being fully decomposed by bacteria or living organisms. The use of this technology demonstrates an ecological friendly method of which this invention represents in its entirety.

The present invention will be described in further detail with referenced FIGS. 1-15. All herein disclosed ranges (including angles) can include individual or fractional percentages or values encompassed thereby such that a range of 1 to 10 would include both values such as 2 or 6, as well as the values 2.1 or 6.7, for example.

Referring initially to FIG. 1, there is shown a three-dimensional view of the assembled single blade disposable shaving razor 100. The architecture can be manufactured from a range of suitable materials typically used in this industry such as; injection molded plastic resin; plant based biodegradable resins but not limited to just these materials. The open frame control handle 101 has essentially no moving components and is permanently fixed to cover 102, which becomes the razor head, which further provides the shaving surface. The non-plastic razor blade 103 is retained in the architecture in a fixed position. Bidirectional passage 104 serves a multifunctional purpose to improve the shaving experience. Horizontal passage 105 also serves as both an inlet and outlet passage to aid in providing a comfortable shave. Adjacent side passage 106 works in unison with bidirectional passage 104 and horizontal passage 105. Control handle 101 has a non-obstructed slot 302 that aligns parallel to the handles upper and lower surfaces. Elements 103, 104 and 106 additionally provide a limitless airway ventilation system throughout head comprising cover 102 that improves upon the hygiene of all the internal surfaces.

Figure 2:
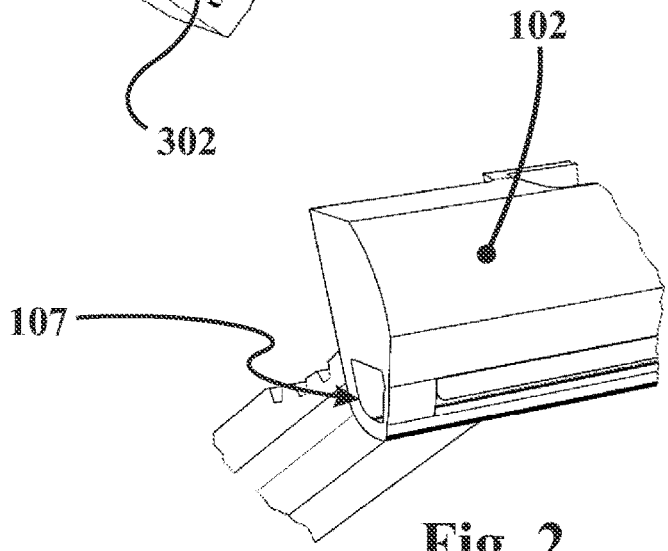
FIG. 2 shows a partial three-dimensional view describing a side passage.

Now referring to FIG. 2, there is shown a partial three-dimensional view of the assembled device 100. Adjacent side passage 107 works in unison with bidirectional passage 104, horizontal passage 105 and adjacent side passage 106. Element 107 in conjunction with said elements 103, 104 and 106 additionally provide a limitless airway ventilation system throughout head 102 that improves upon the hygiene of all the internal surfaces.

Figure 3:
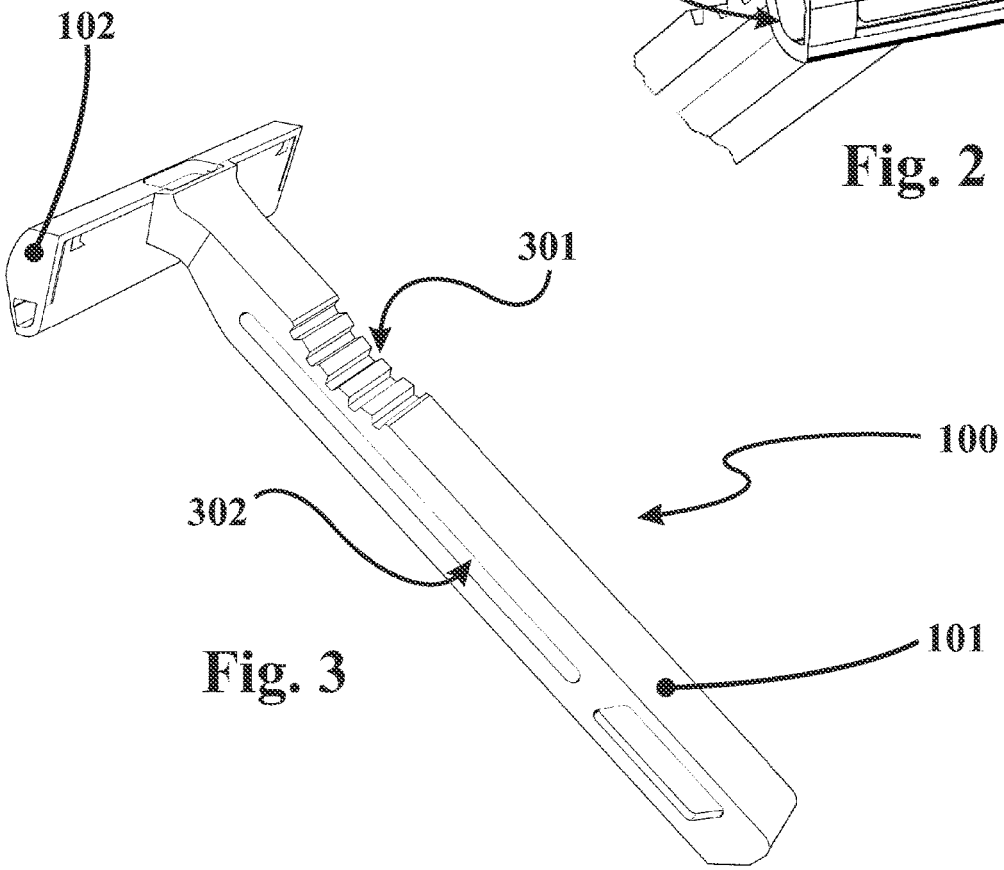
FIG. 3 shows a three-dimensional view describing the benefits of the devices handle.

Now referring to FIG. 3 there is shown a three-dimensional view of the assembled device 100. The view further shows a control handle with geometric features of the device 100. Central slot opening length of 302 is approximately 80% of the handle's overall length. Partial convex ribbed curve 301 is located at the termination of the smooth upper handle surface. Item 301 is ribbed as shown such that it will fill with liquids mostly found on one's fingers when shaving. Slot 302 acts as a drain that can transfer liquid from one's hand and fingers to pass through the handle's normal axis.

Figure 4:
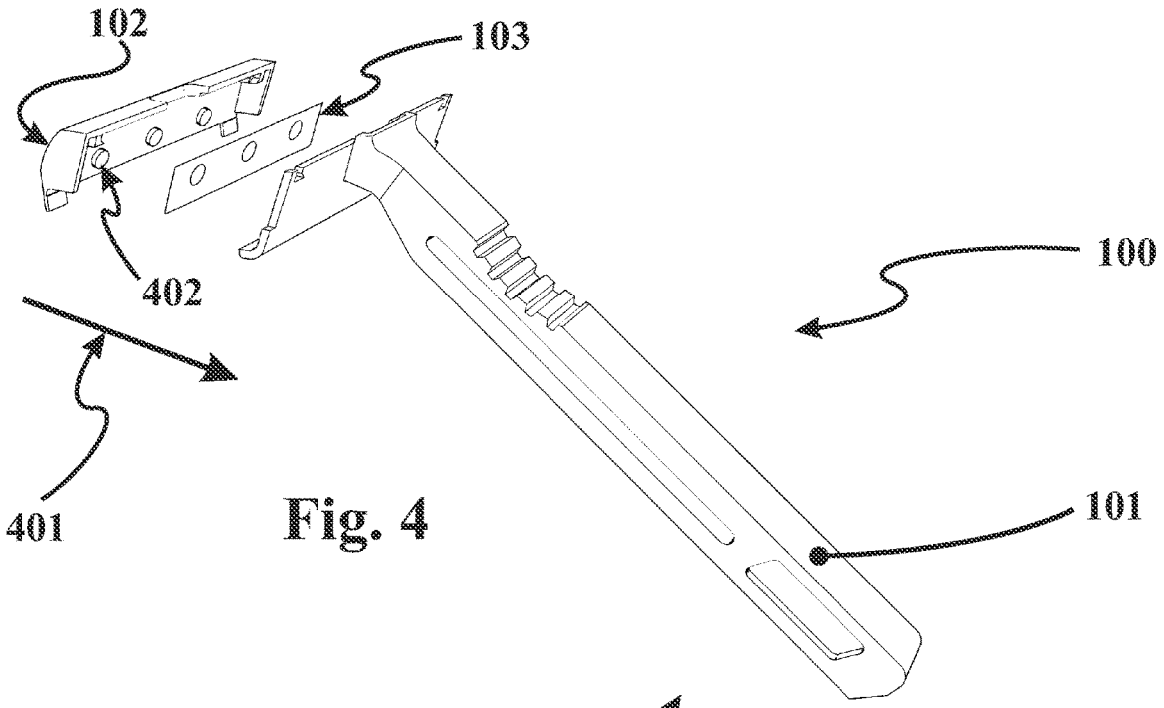
FIG. 4 shows three-dimensional exploded view describing the overall components.

Now referring to three-dimensional view of FIG. 4, there is shown an exploded three-dimensional view describing the unassembled components of the shaving razor 100. The control handle 101 becomes permanently attached to cover 102 and metallic razor blade 103 in the assembly direction of 401. Blade 103 is permanently held in place with a series of three similar feature protrusions 402 found on cover 102 that align with three mating holes found on blade 103. The bonding method can be achieved either; applying local heat to 402, which will fuse the components or the usage of an epoxy at all mating junctions of 103 and 402. Said bonding methods are not to be understood as limited or absolute. The assembled device 100, which is then permanently joined to cover 102 and blade 103, will function with no moving parts. Bonding cover 102 with handle 101 can be achieved either; applying local heat to the junction seam, which will fuse the components or the usage of an epoxy at all mating junctions of cover 102 and handle 101. Said bonding methods are not to be understood as limited or absolute.

Figure 5:
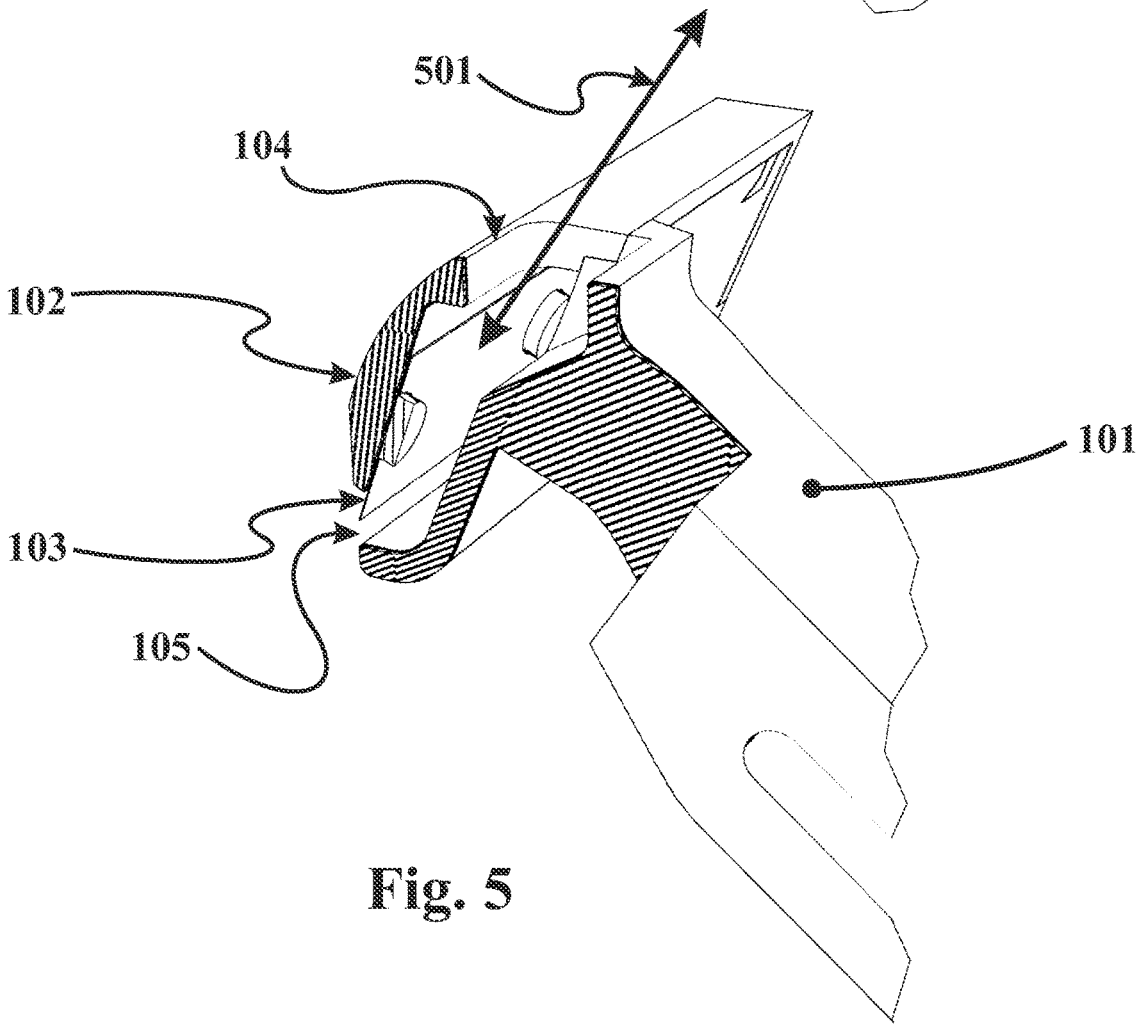
FIG. 5 shows a partial cross-sectional elevation view describing the bidirectional passage.

FIG. 5 illustrates the function of the formed internal process cavity which is produced by joining said components that are described in FIG. 4. The formed bidirectional passage 104 provides access to the internal process cavity and or an airway passageway along either direction of 501. The passage will have a direct thermal impact on the metallic razor blade 103 when tempered tap water is directed into said passage. The introduced tap water temperature can typically range from as low as approximately 50 degrees Fahrenheit to as high as approximately 120 degrees Fahrenheit. The metallic razor blade will retain the tempered water temperature due to its surface being fully exposed to the impingement and then stored tempered liquid that's retained in process cavity 601.

Extensive shaving razor prototype studies have concluded; the ideal water flow path needs to travel in one dominate direction and within the shortest distance possible in order to reach the exposed surface of blade 103. Experiments additionally concluded the geometric size of the exposed surface area of blade 103 is most effective when it is as large as possible. The experiments have also confirmed the usage of; impingement baffles, turning vanes, ribs or hydraulic obstructions will demise the thermal performance. In conclusion, having a non-obstructed internal process cavity by design will provide the optimal retainable metal blade temperature.

Bidirectional passage 104 further communicates with the horizontal discharge passage 105, which is ideally positioned below the shearing edge of the razor blade 103. The user can adjust the entering tap water setting to provide their desired shave temperature. Passage 105 allows the exiting tempered tap water to slowly weep out as it moistens and or naturally lubricates the user's shaving surface during the shave process. The liquid discharge ideally occurs just prior to the blade shearing the hair follicles. This procedure helps to reduce common razor burn and skin irritation.

The internal process cavity systematically communicates with adjacent side passage 106 described in FIG. 1 and adjacent side passage 107 described in FIG. 2. When the hydrodynamic fluid force of said tap water enters bidirectional passage 104 the dual adjacent side passages 106 and 107 in conjunction with horizontal passage 105 allows for an effective and immediate process cavity clean-out. This repeated step is routinely performed during the shave procedure to discharge the accumulated trimmed hair follicle, skin scaling and topical shaving lather that would ordinarily blind the razor blades shearing edge. Said tap water can bidirectionally enter and/or exit through any of the said four-passages to achieve the clean-out process. Achieving an effective clean-out is not limited to using only one dedicated entry of the said four-passages.

Extensive shaving razor prototype studies have concluded; the ideal water flow path needs to travel in one dominate direction and within the shortest distance possible in order to efficiently clear away the accumulated debris mentioned above. Experimentation investigated and concluded that having internal features such as; swirl induction, turning vanes, static mixers or complex internal flow paths do not work, they actually hinder the cleaning performance. This device employs minimal material obstructions and minimal internal surface areas. This device relies upon having the ideal cubic size of process cavity 601 in conjunction with respective passages of elements; 103, 104, 106, 107 and their given flow areas.

Bidirectional passage 104 additionally provides a central entry location for all flowable type materials such as; topical shaving lather, shaving cream, shaving foam, shaving gel, skin oil, liquid soap antibacterial agents and or water that are normally used during the shaving process. Said flowable materials are not to be understood as limited or absolute. Passage 104 is ideally sized to accommodate the discharge nozzles found on all commercially sold pressurized shaving lather aerosol canisters and non-pressurized mechanical pump type canister products, without the need to adjust or use additional attachable type fittings. Said topical lather and the like is temporally retained in the process cavity, then to be naturally discharged through passage 105 for the purpose of either; rendering care assist for someone who cannot shave themselves or for touching up following the completed shave without the need to apply lather to one's shaving surface.

Figure 6:
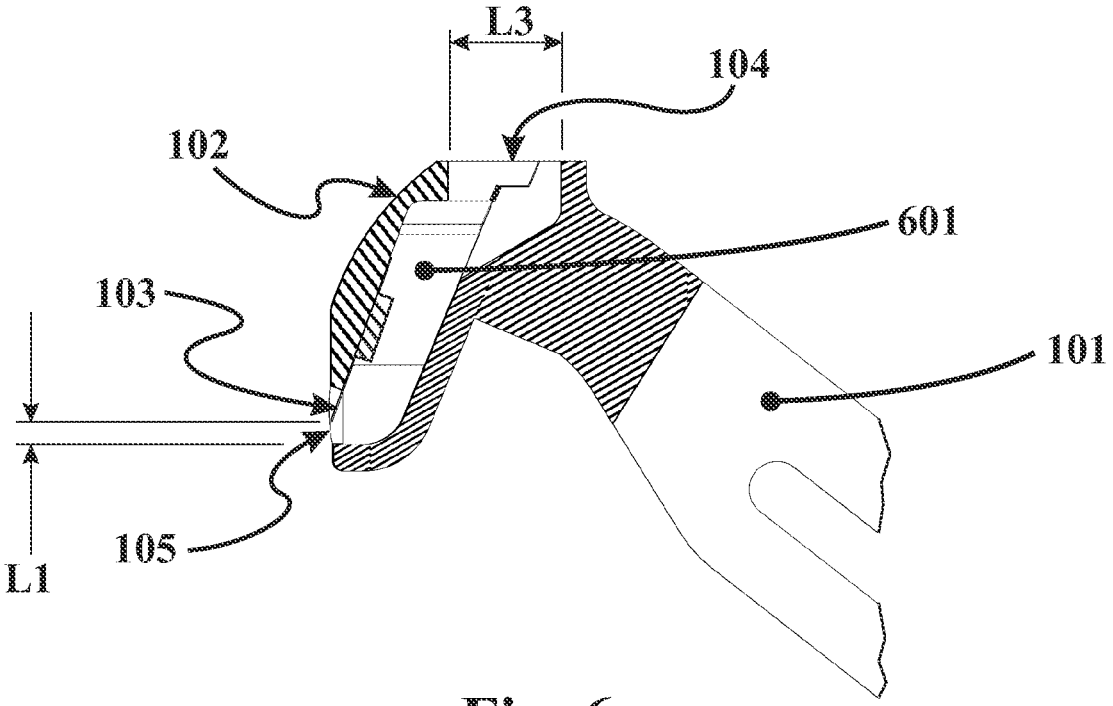
FIG. 6 shows a partial cross-sectional elevation view describing the internal process cavity.

Now referring to partial cross-sectional view of FIG. 6, which describes the vertical length of passage 105 in L1. Length L1 can be between 0.01" to 0.30" with 0.10" to 0.18" being preferred and with 0.07" being most preferred. The horizontal length of portal 104 in L3. Length L3 can be between 0.06" to 0.50" with 0.21" to 0.42" being preferred and with 0.17" being most preferred. The total volumetric area of the process cavity 601, can be between 0.06 cubic inches to 0.20 cubic inches with 0.08 cubic inches to 0.18 cubic inches being preferred and with 0.11 cubic inches being most preferred. Elements 104 and 105 in conjunction additionally provide a limitless airway ventilation system throughout the process cavity 601, which improves upon the hygiene of the internal resin surfaces including the metal blade 103. The total exposed surface area of blade 103, can be between 0.50 square inches to 1.10 square inches with 0.60 square inches to 0.80 square inches being preferred and with 0.75 square inches being most preferred. Said blades exposed surface area faces the process cavity 601, which is aforementioned and shown in FIG. 5.

Figure 7:
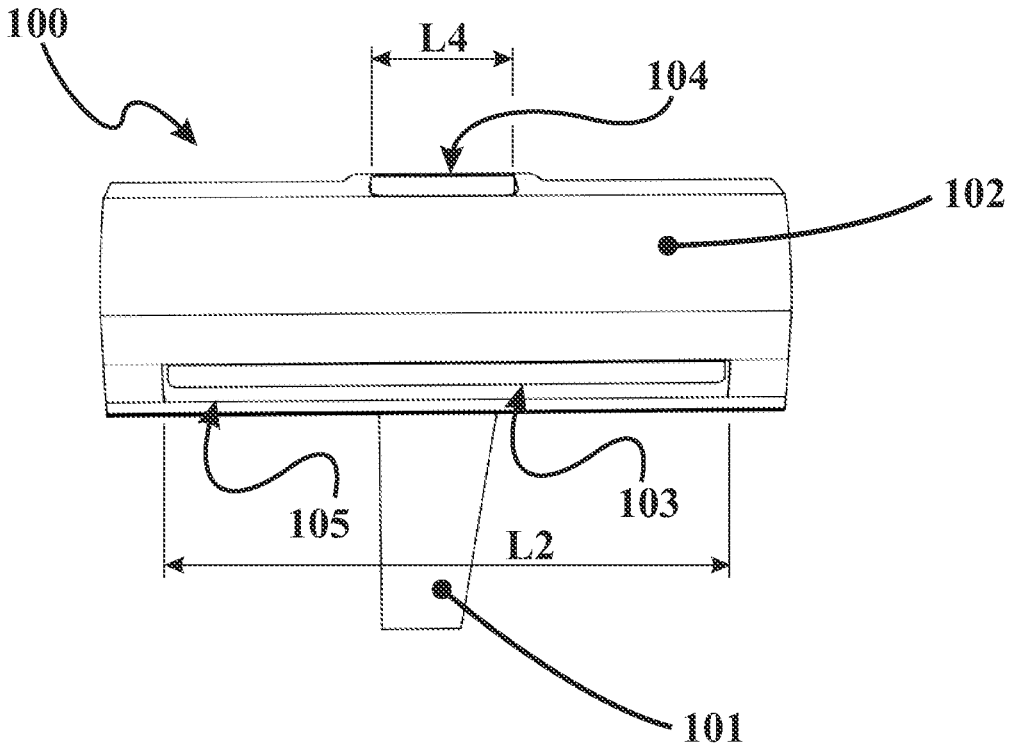
FIG. 7 shows a front elevation view describing passage inlet and outlet lengths.

Now referring to the front elevation view of FIG. 7, which describes the overall length of horizontal passage 105 in L2. Length L2 can be between 1.2" to 2.0" with 1.60" to 1.80" being preferred and with 1.52" being most preferred. The overall length of bidirectional passage 104 in L4. Length L4 can be between 0.22" to 0.96" with 0.50" to 0.88" being preferred and with 0.40" being most preferred.

Figure 8:
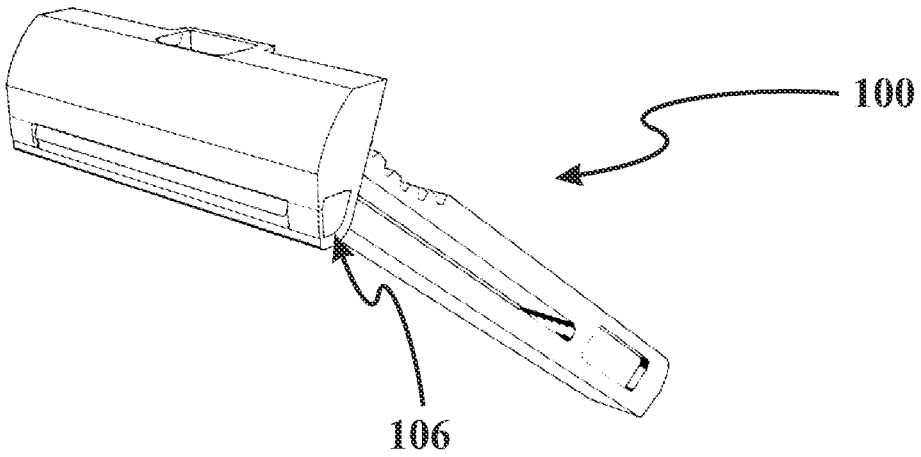
FIG. 8 shows a three-dimensional view, which addresses an adjacent side passage.

Now referring to FIG. 8 there is a three-dimensional view of the assembled device 100. The adjacent side passage 106 having an open polynomial shape. The passage can be between 0.009 square inches to 0.10 square inches with 0.02 square inches to 0.05 square inches being preferred and with 0.017 square inches being most preferred.

Figure 9:
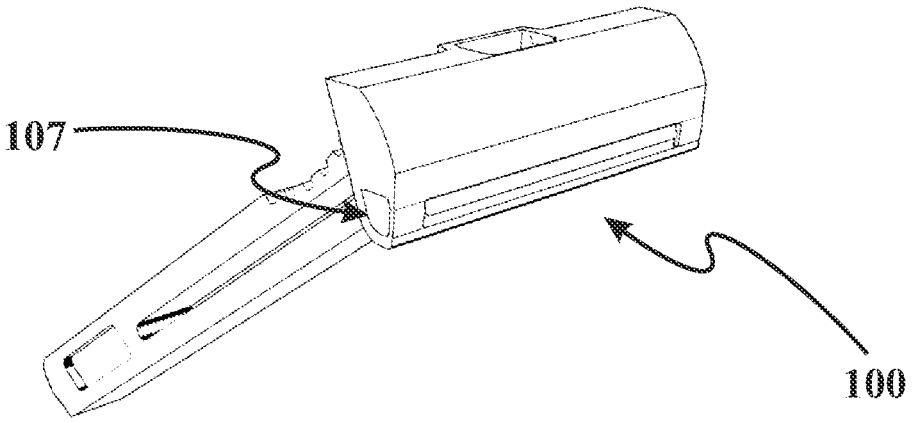
FIG. 9 shows a three-dimensional view, which addresses an adjacent side passage.

Now referring to FIG. 9 there is a three-dimensional view of the assembled device 100. The adjacent side passage 107 having an open polynomial shape. The passage can be between 0.009 square inches to 0.10 square inches with 0.02 square inches to 0.05 square inches being preferred and with 0.017 square inches being most preferred.

Figure 10:
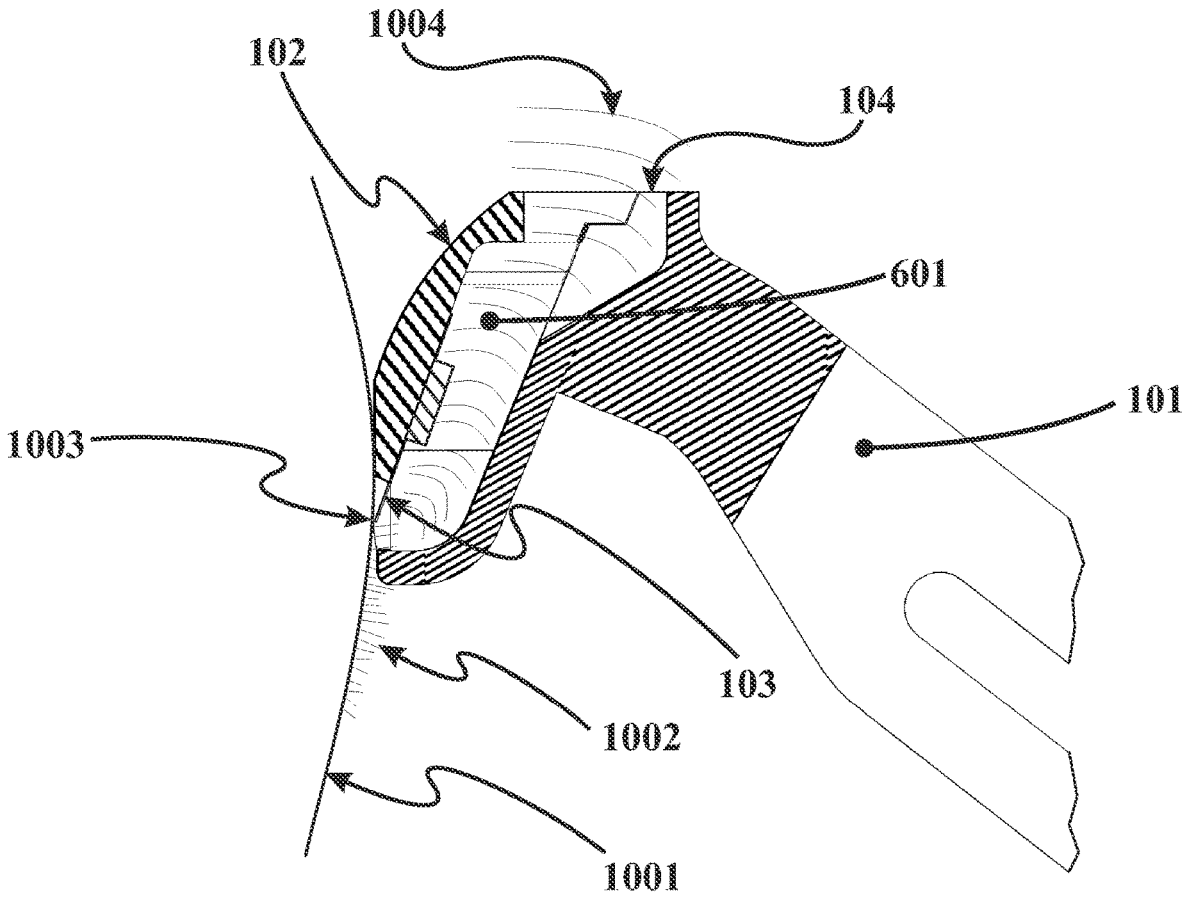
FIG. 10 shows a partial cross-sectional elevation view describing the acoustic effect.

FIG. 10, describes a feature that will audibly alert the user to the best suitable shaving angle. Item 1001 represents a typical side profile shaving surface having hair follicles 1002. The devices geometric side profile of an outwardly projected skin contacting shaving surface of cover 102, which is the only portion of said device that comes in direct contact with the hair follicles and skin tissue. Razor blade 103 is fixed to the architecture of cover 102 and relies on the correct angle of handle 101 to provide an acceptable shave. When blade 103 shears the hair follicles 1002 at the theoretical intersection 1003 the ideal angle creates a natural audible resonance that is generated within the process cavity 601. Sound waves 1004 travel through the bidirectional passage 104, which provides the user with guidance such that the desired angle of handle 101 can be adjusted as required. Acoustic comparison studies have been made against this invention and commercially available counter units. The data demonstrated this invention will produce an approximately 52% higher decibel level than other razor units.

Figure 11:
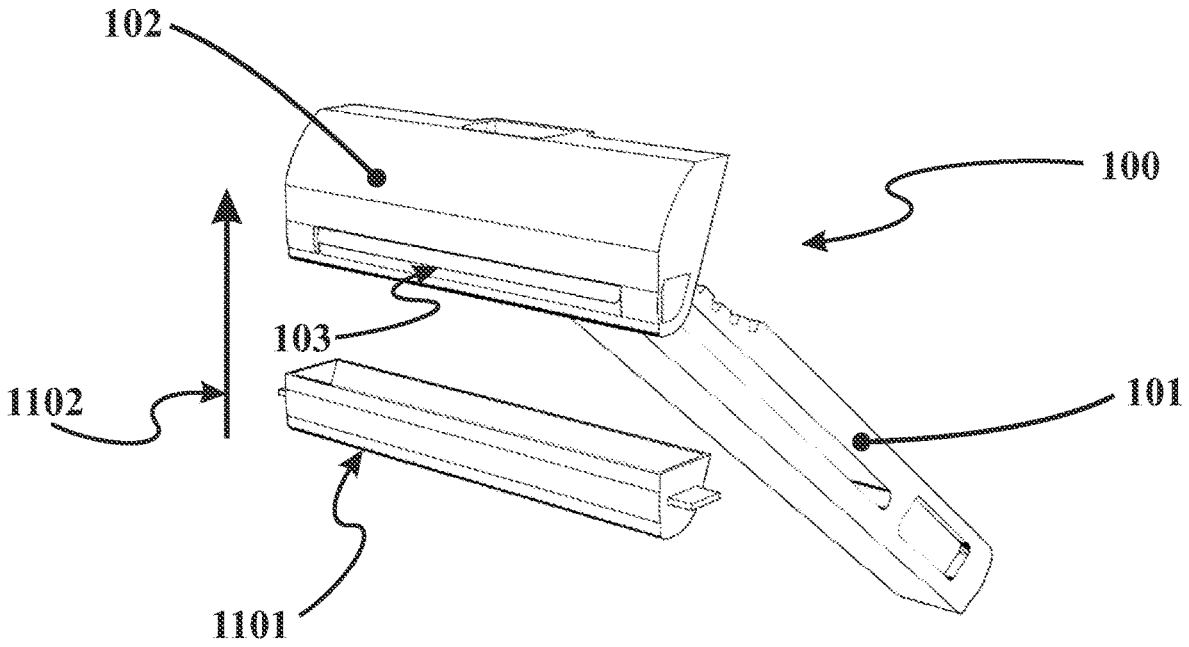
FIG. 11 shows a three-dimensional view describing the devices blade safety and liquid hygienic attachable retainer.

Now referring to three-dimensional view of FIG. 11 shows a dual-purpose razor blade safety guard 1101 and the interaction between devices 100 and 1101. The safety guard in its entirety slips into position in the specified location on device 100 as shown along direction 1102. The attached engagement will protect one's skin from coming in direct contact with the razor blades exposed sharp shear edge.

Figure 12:
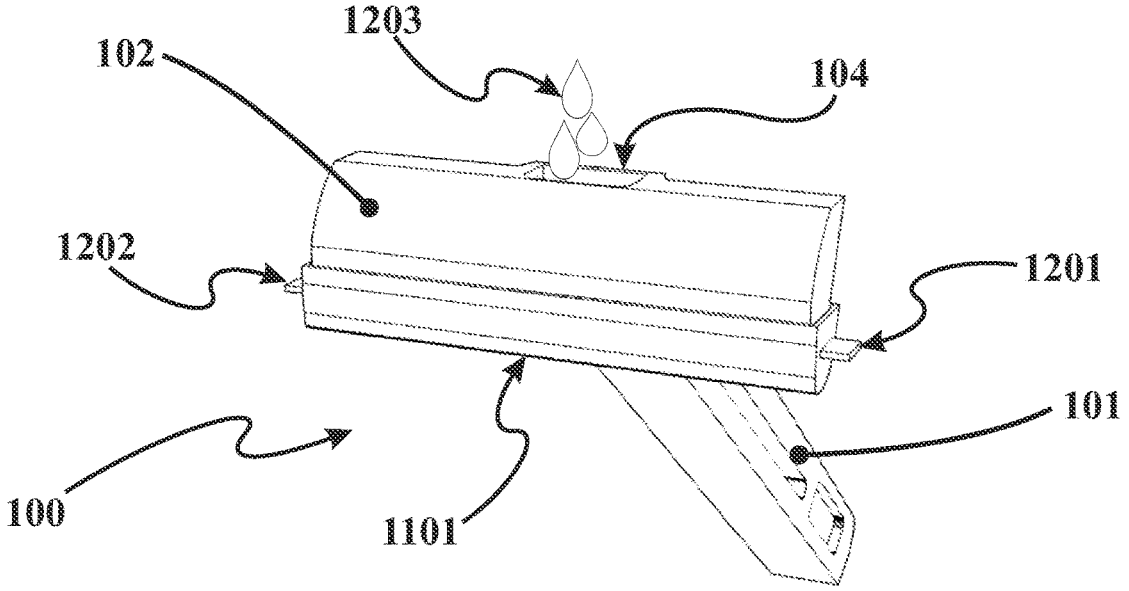
FIG. 12 shows a three-dimensional view describing the bidirectional passage, which is used to fill the engaged retainer with an antibacterial liquid.

FIG. 12 illustrates the final engagement between devices 100 and 1101. A temporary lock-on engagement provides a sufficient frication type union. A few drops of commercially available anti-bacterial liquid agent 1203 is added into the bidirectional passage 104, which coats the exposed surface of the entire metallic razor blade including the inner surfaces of the process cavity 601. Process cavity 601 has been described in FIG. 6. The residue amount of liquid is retained in device 1101 due to its sealed geometric shape. The engaged assembly provides a reasonably tight liquid seal, which also blinds the horizontal passage 105 shown in FIG. 11 and adjacent side passage 106 shown in FIG. 8 and adjacent side passage 107 shown in FIG. 9.

The purpose is aimed at preventing bacteria and germ growth at the blades surface, which comes in direct contact with one's skin tissue. A second incentive is to displace water from the blades surface, which is often the cause of premature metal corrosion. The material breakdown leads to a dull shearing edge. Quenching the blades metal surface in an alcohol-based agent will increase the razor blades cutting life-span. Bidirectional passage 104 provides a limitless airway ventilation system to promote an improved hygiene to all internal surfaces that comprise head 102.

The protruding end features shown as 1201 and 1202 can be used to push device 1101 in the opposite direction that is depicted in FIG. 11 to disengage the safety guard.

Figure 13:
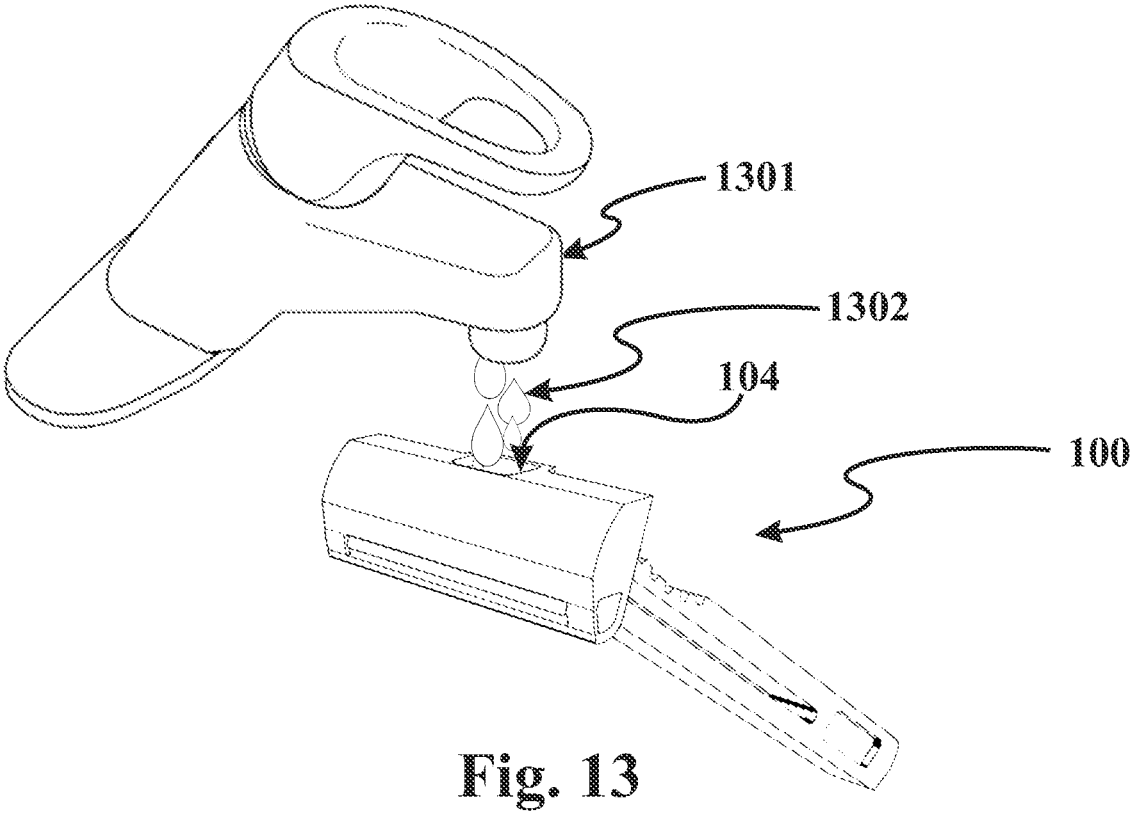
FIG. 13 shows a three-dimensional view describing a method of introducing tap water.

FIG. 13 illustrates the method of introducing tempered tap water into device 100 from a typical sink faucet 1301. Tempered liquid stream 1302 enters the bidirectional passage 104, which fills the process cavity 601 that was aforementioned in FIG. 6. Benefits describing the purpose of B using tempered tap water was aforementioned in FIG. 5.

Figure 14:
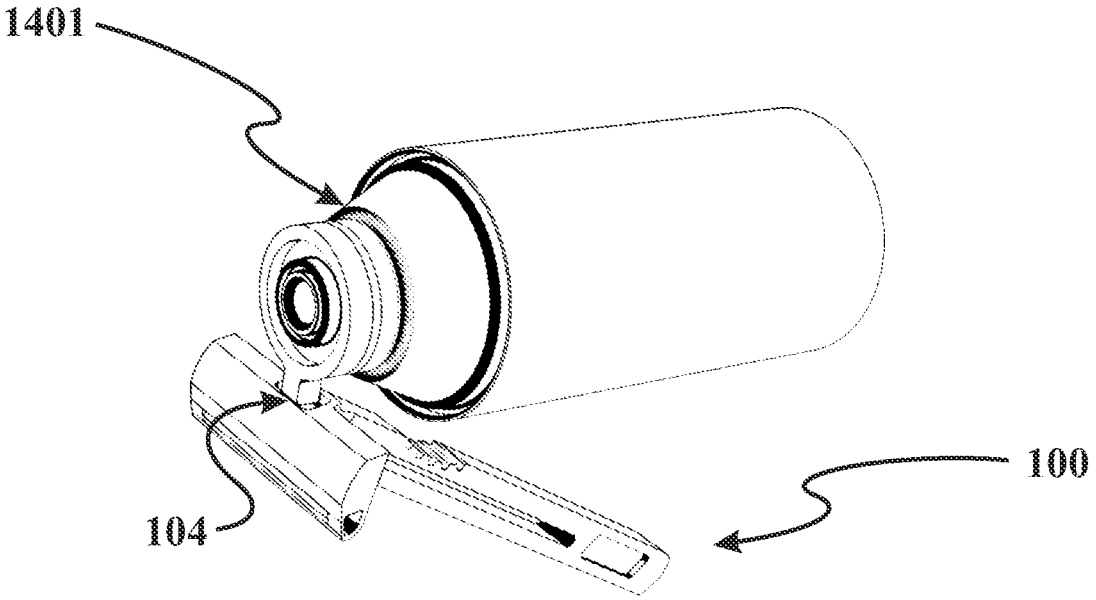
FIG. 14 shows a three-dimensional view describing a method of introducing shaving lather.

FIG. 14 illustrates the method of introducing shaving lather into device 100 from a typical commercially available product 1401. The illustration of the pressurized canister should not be understood as limited or absolute. Handpump dispensers and or pour caps can be used if so desired. The fluid stream of the soft flowable type material enters the bidirectional passage 104, which fills the process cavity 601 that was aforementioned in FIG. 6. Benefits describing the purpose of using B said shaving lather and the like was aforementioned in FIG. 5.

Figure 15:
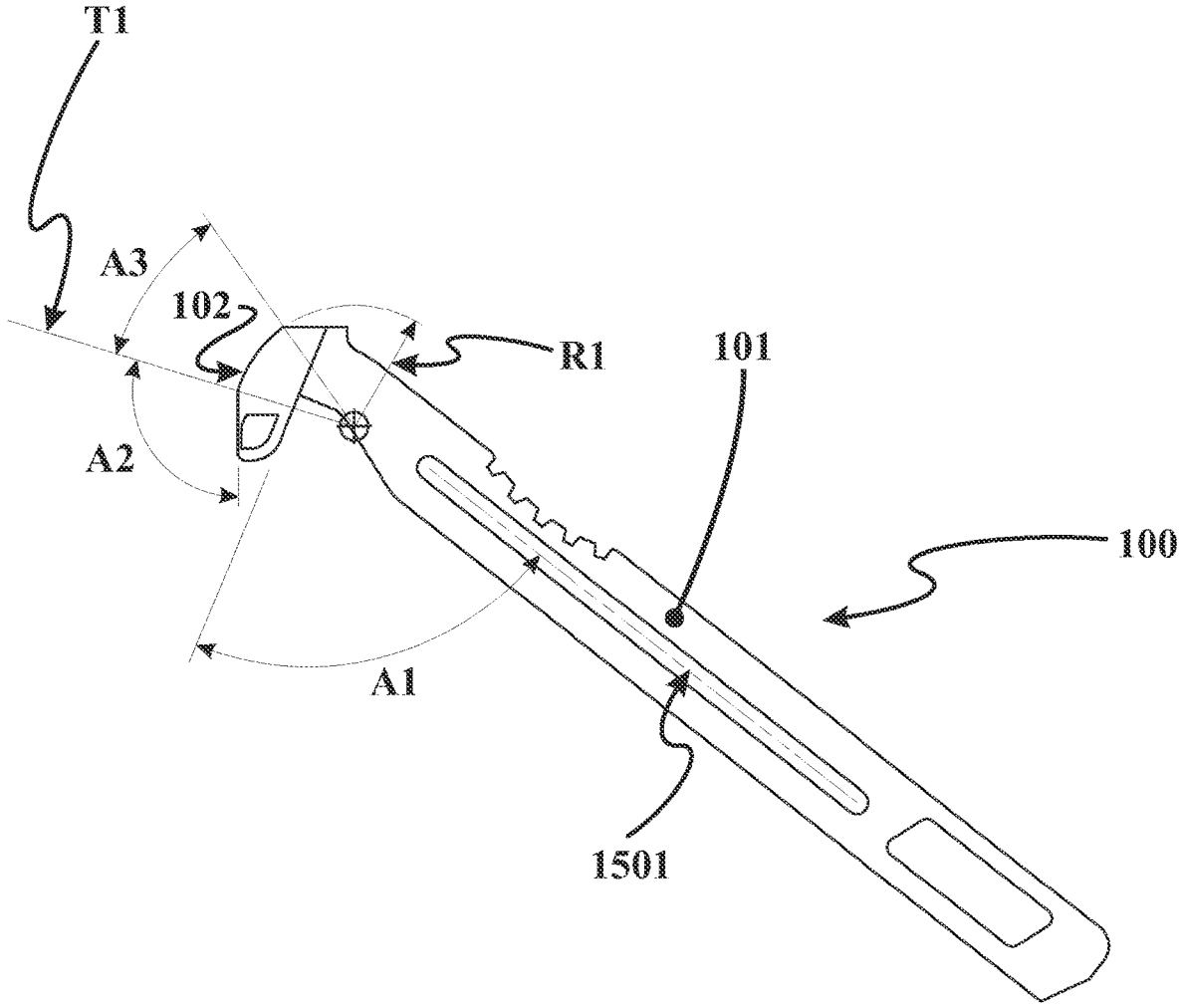
FIG. 15 shows a side elevation view that describe relative dimensions between the devices head and handle.

Now referring to the side elevation view of FIG. 15 of device 100. Arc radius R1 that defines the outward projecting skin contacting surface of head 102 whereas radius R1 can be between 0.25" to 1.0" with 0.40" to 0.75" being preferred and with 0.50" being most preferred. Angle A1 is measured from the centroid 1501 of handle 101, can be between 71 Degrees to 79 Degrees with 72 Degrees to 76 Degrees being preferred and with 74 Degrees being most preferred.

Angle A2 is measured from tangential junction T1 with radius R1 on head 102, can be between 102 Degrees to 112 Degrees with 105 Degrees to 109 Degrees being preferred and with 107 Degrees being most preferred. Angle A3 measured from tangential junction T1 to the termination with radius R1 on head 102, can be between 33 Degrees to 43 Degrees with 36 Degrees to 40 Degrees being preferred and with 38 Degrees being most preferred.

What is claimed:

1. A unisex disposable safety razor comprising a head having a cover portion and a base portion;

the cover portion having an exterior skin contacting surface, a second exterior surface, two opposed side surfaces, and at least one interior surface;

the base portion having a curved interior surface and an exterior surface;

the second exterior surface of the cover portion and the base portion at least partially define a bi-directional passage;

one of the side surfaces of the cover portion and the base portion define a first side passage;

the at least one interior surface of the cover portion and the curved interior surface of the base portion define an internal process cavity;

an end of the exterior contact surface is spaced from an end of the curved interior surface to define a second passage;

only one blade with a cutting edge, the blade is in the internal process cavity lying flat against the at least one interior surface of the cover portion so that the cutting edge is in the second passage;

the bi-directional passage, the first side passage, and the second passage are all in communication via the internal process cavity; and a handle connected to the exterior surface of the base portion.

2. The razor of claim 1, wherein the handle comprises a slotted through opening and an indentation.

3. The razor of claim 1, wherein the handle has a generally rectangular cross-section.

4. The razor of claim 1, wherein the head is non-movable fixed to the handle.

5. The razor of claim 1, wherein the head is angled relative to the handle.

6. The razor of claim 1, wherein the second passage, the internal process cavity, and the bi-directional passage are configured to cooperate to transmit sound vibrations.

7. The razor of claim 1, wherein another one of the side surfaces and the base portion define a second side passage opposed to the first side passage, the second side passage is in communication with the internal process cavity, the first side passage is adjacent an end of the blade, and the second side passage is adjacent an opposite end of the blade.

8. The razor of claim 1, wherein the second passage is parallel to the cutting edge of the blade and has a length equal to or greater than a length of the blade.

9. The razor of claim 1, wherein the head and handle are made from biodegradable plant-based granular composition resin slurry.

10. The razor of claim 1, wherein the blade is substantially parallel to and permanently joined with the at least one interior surface of the cover portion.

11. The razor of claim 1, wherein the internal process cavity and the blade are configured so that a liquid received in the internal process cavity via the bi-directional passage immediately impinge an exposed surface of the blade so that the blade reacts to a temperature of the liquid.

12. The razor of claim 1, wherein the blade is metal.

13. A shaving system comprising the razor of claim 1 and a removably installable covering.

14. The system of claim 12, wherein the covering has an internal fluid retaining space, an internal storage length greater than a length of the head, and an internal storage width greater than a width of the head;

when the covering is installed on the head, the covering has a contact seal with the head and the second passage and the first side passage are received in the internal fluid retaining space so as to block the second passage and the first side passage to allow a liquid received in the bi-directional passage to be temporarily retained in the process cavity.

* * * * *